US006860210B2

(12) United States Patent
Baier

(10) Patent No.: US 6,860,210 B2
(45) Date of Patent: Mar. 1, 2005

(54) RAIL VEHICLE SYSTEM

(76) Inventor: Michael Baier, Sankt-Ingberter-Strasse 2, D-68309 Mannheim (DE)

( * ) Notice: Subject to any disclaimer, the term of this patent is extended or adjusted under 35 U.S.C. 154(b) by 36 days.

(21) Appl. No.: 10/166,540

(22) Filed: Jun. 11, 2002

(65) Prior Publication Data

US 2003/0084814 A1 May 8, 2003

Related U.S. Application Data

(62) Division of application No. 09/530,624, filed as application No. PCT/EP98/06886 on Oct. 30, 1998, now Pat. No. 6,474,242.

(30) Foreign Application Priority Data

Nov. 5, 1997 (DE) ..... 197 48 732
Apr. 29, 1998 (DE) ..... 198 19 094

(51) Int. Cl.[7] ..... B61D 1/00
(52) U.S. Cl. ..... 105/167; 105/182.1; 105/3
(58) Field of Search ..... 105/182.1, 167, 105/4.1, 4.2, 1.5, 29.2, 34.1, 49, 3, 35, 136, 27, 1.4, 50, 54, 231, 26.05, 397; 191/23 A, 33 R, 45 R, 47, 46; 318/729

(56) References Cited

U.S. PATENT DOCUMENTS 2,170,095 A * 8/1939 Ronk ..... 105/4.2
4,809,616 A * 3/1989 Piel ..... 105/73
4,811,668 A * 3/1989 Moehling ..... 105/4.1
4,867,072 A * 9/1989 Kleim et al. ..... 105/133
4,913,060 A * 4/1990 Sekine et al. ..... 105/96
5,261,330 A * 11/1993 Veit-Salomon et al. ..... 105/3
5,796,224 A * 8/1998 Hayashi et al. ..... 318/139
5,823,371 A * 10/1998 Riley et al. ..... 213/75 TC
6,021,718 A * 2/2000 Kroll et al. ..... 105/3
6,095,055 A * 8/2000 Lohr et al. ..... 105/4.2

FOREIGN PATENT DOCUMENTS

DE 4419851 A1 * 12/1995
DE 4419851 A1 * 12/1995 ..... B61C/17/12
JP 03-190508 A * 3/1991
JP 03191518 A * 8/1991 ..... H01L/21/28
WO WO 99/22120 A1 * 5/1999

* cited by examiner

*Primary Examiner*—Frantz F. Jules

(57) ABSTRACT

A rail vehicle system that has connecting bogies, supply units, control units, and transportation units, which can be placed on said connecting bogies in order to form a train with a modular construction. The connecting bogies contain at least two axles, one of which is equipped with an electrical drive/brake unit, and which are configured so that they can be separated in a clutch-like manner. The supply units may contain vital devices such as current collectors, transformers and power converters for extracting power form a contact line and feeding it back into the contract line or converters of primary energy or electrical energy. The control units can be configured to be independent of current and load. The transportation units may differ according to whether they are for transporting passengers or goods and according to the type of goods being transported. The interfaces of all of the units are uniform and are configured in such a way that the units can be interchanged quickly and easily. The resulting consistent division of train into functional units enables the driving power to be better adapted to the load, creates possibilities for generating and using energy and reduces operating/maintenance costs.

16 Claims, 1 Drawing Sheet

RAIL VEHICLE SYSTEM

BACKGROUND OF THE INVENTION

1. Field of the Invention

The invention relates to a rail vehicle system which contains functional units for forming a train.

2. Description of the Related Art

Conventional rail vehicle concepts are based on a functional division between "produce transport speed", realized by a locomotive, and "accommodate material to be transported", realized by cars. Based on this rigid functional division, different locomotive/train types have developed.

Subfunctions of the production of the transport speed are the "driving" and "braking" functions. The acceleration forces of the "driving" function are transmitted exclusively via the wheel/rail contact of the locomotive; for braking, the brake with its car-wheel/rail contact is additionally used. The locomotive drive in the case of electrically driven units may be used as a generator during braking operation, the energy generated being fed back into the network or being dissipated via a braking resistor. In principle, recovery/generation of electrical energy can also be realized in diesel-driven or diesel-electric-driven units. On the other hand, the train brake works pneumatically/mechanically and permits no feedback of energy. It is subjected to considerable wear and causes high operating costs.

In the passenger transport sector, initial trends toward another functional division can be recognized. In the ICE3, for example, "driving bogies" are being used for the first time, but are not distributed consistently over the entire train. In the ICE3 there are non-driven axles and there is thus a demand for a very distinctive pneumatic locomotive/train braking system.

BRIEF SUMMARY OF THE INVENTION

The object of the invention is to specify a rail vehicle system which permits a universal train makeup which is tailored to the requirements and can be changed during the operating period and which in the process gives rise to improvements with regard to the energy requirement and the operating costs.

This object is achieved by a rail vehicle system having modular functional units as claimed in claim 1. Advantageous refinements are specified in further claims.

The rail vehicle system has connecting bogies, and functional units, control units and transport units mounted on said connecting bogies, as functional units which can be made up in a modular manner. In addition to the carrying function for control, supply or transport units, the connecting bogies perform both the driving and braking function and a coupling function. The modular train construction system thus proposed has a number of advantages. The functional units can be made up in any desired manner to form a train, all the wheel sets being electrically driven or braked. The motorization of the connecting bogies may be realized as a function of load in construction series for different power outputs. Connecting bogies of different power can be combined. Transport units of different type can be arranged on the connecting bogies. Transport units for passengers and freight can be combined in one train. The transport units for freight may differ in a conventional manner according to container transport, bulk-material transport and other transport. Control units can be arranged at the start of the train and/or at the end of the train, in which case the control units may be independent of the type of train and the driving power.

In a refinement of the invention, the connecting bogies are designed in such a way that the connection between two connecting-bogie halves can be made mechanically, magnetically/electromagnetically or even in a non-contact manner and with controlled drives. Coupling and uncoupling of further units, such as supply units, control units and/or transport units, on the corresponding connecting-bogie halves is advantageously also possible during the journey.

BRIEF DESCRIPTION OF THE DRAWINGS

Further details and advantages follow from the description below of a train shown by way of example in the drawing.

Figure 1:
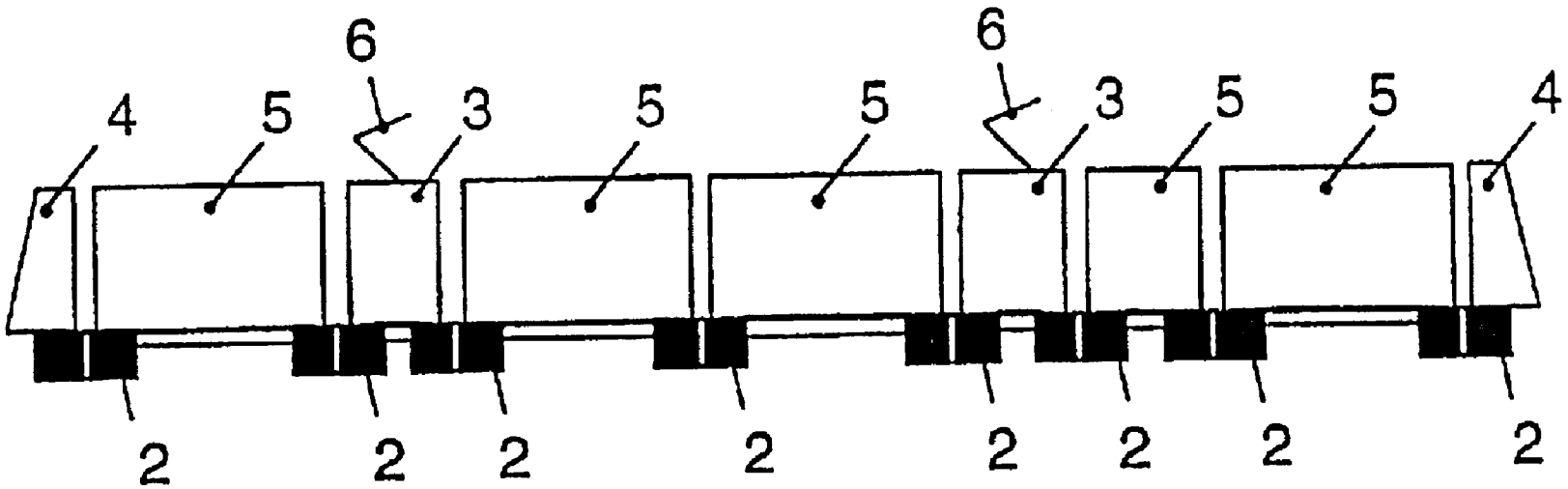
FIG. 1 shows a train 1 made up in a modular manner, in which supply units 3, control units 4 and transport units 5 are mounted on connecting bogies 2.

The connecting bogies 2 each have at least two axles with in each case an electrical driving/braking unit. They are designed to be separable, so that they perform a coupling function. Such connecting bogies 2 are available with different driving/braking power. As a special module along the lines of a modular train construction system, connecting bogies in which only one of the axles is driven or braked are also possible.

The supply units 3 contain the requisite devices, such as current collector 6, transformer and power converter, for drawing current from an overhead traction wire and for feeding energy back into the overhead traction wire or for converting fossil energy into electrical energy. A unit may be included for converting primary energy into electrical energy, such as, for example, a generator which is driven by a diesel engine, and for producing electrical drive energy for the connecting bogie drives, energy recovered during the braking being stored temporarily in a supply unit 3 provided with energy storage devices or being fed to a network. The supply units 3 are also available for different power outputs in the rail vehicle system. Universal control units 4, on the other hand, may be designed to be independent of load or power.

Transport units 5 are designed to differ, depending on passenger or freight transport and also depending on the type of freight to be transported.

A plurality of supply units 3 can be arranged in the train for adaptation to the respective driving power and in order to make the train separable. As a rule, a train formed in such a way contains only electrically driven and braked axles, as a result of which an increased feedback of energy is made possible. The total energy balance of a railroad system is considerably improved. Although additional pneumatically or mechanically acting brakes are necessary, their use is considerably reduced. Smaller dimensions and a reduction in wear can be realized. The driving power can be readily adapted to the temporarily induced actual conditions.

DESCRIPTION OF ILLUSTRATIVE EMBODIMENTS

Graduation of the power of the connecting bogies and supply units along the lines of a series design enables freight transport elements to be carried in the passenger train combination during operating periods when passenger traffic is slack. It is conceivable for control units, after the train has been split up at any point of the train combination—possibly even during the journey—to continue to travel separately with the train sections thus produced to different destination stations, or they could be coupled to other train sections conceived in the same manner to make new mixed combinations. As a result, the transport capacity of individual routes can be optimized and improved train scheduling can be made possible.

In a further design of the rail vehicle system according to the invention, decentralized controllers (control units) are integrated in the individual connecting bogies 2. A central vehicle control computer is located in a control unit 4. The current loading of the individual axles of the connecting bogies 2 is detected via load sensors and communicated to the corresponding decentralized controller. Each of the decentralized controllers, in communication with the central vehicle control computer via a bus system, is thus able to regulate, that is to drive or brake, the individual axles separately in line with demand as a function of the current type of loading and the train state. Furthermore, this permits a train combination with coupled drives in which all the units, such as supply units 3, control units 4 and transport units 5, travel one behind the other with controlled drives without a direct requirement for a mechanical or electromagnetic coupling.

What is claimed is:

1. A rail vehicle system comprising: connecting bogies; supply units; control units; and transport units; each of which can be mounted on said connecting bogies as functional units which can be combined in a modular manner to form a train; wherein the connecting bogies are separable into two halves, have at least two axles, of which at least one is provided with an electrical driving/braking unit, and the connecting bogies combined to form the train may have different driving/braking power from each other;

the supply units are adapted for drawing current from and feeding it back into an overhead traction wire or for converting fossil energy into electrical energy the control units are designed to be universally usable independently of load or power;

the transport units are designed to differ for passenger or freight transport and also according to the type of freight to be transported; and the control units, the supply units and the transport units are connected to one another by the connecting bogies.

2. The rail vehicle system as claimed in claim 1, wherein the connecting bogies comprise connecting-bogie halves, the connection between two connecting-bogie halves being made mechanically, magnetically or in a non-contacting manner.

3. The rail vehicle system as claimed in claim 2, further comprising a unit for converting primary energy into electrical energy, and for producing electrical drive energy for the connecting-bogie drives.

4. The rail system as claimed in claim 1 further comprising a unit for converting primary energy into electrical energy, and for producing electrical drive energy for connecting-bogie drives.

5. The rail vehicle system as claimed in claim 1, wherein energy recovered during braking is stored temporarily in one of the supply units which is provided with energy storage devices.

6. The rail vehicle system as claimed in claim 5, wherein the energy recovered during braking is fed to a network.

7. A rail vehicle system comprising:

a plurality of connecting bogies, each bogie capable of being separated into two halves and having at least two axles, of which at least one axle is provided with an electrical driving/braking unit;

one or more supply units for drawing current from and feeding it back into an overhead traction wire or converting primary energy into electrical energy;

one or more control units; and one or more transport units for passenger or freight transport, wherein the control units, supply units, and transport units are connected to one another by the connecting bogies.

8. The rail vehicle system as claimed in claim 7, wherein the supply units, control units, and transport units can be mounted on said connecting bogies as functional units which can be combined in a modular manner to form a train.

9. The rail vehicle system as claimed in claim 8, wherein the connecting bogie halves are capable of being connected mechanically, magnetically/electromagnetically, or in a non-contact manner.

10. The rail vehicle system as claimed in claim 8, wherein the connecting bogie halves perform a coupling function.

11. The rail vehicle system as claimed in claim 10, wherein the electrical driving/braking unit of at least one of the connecting bogies has a different power output from the electrical driving/braking unit of one of the other connecting bogies.

12. The rail vehicle system as claimed in claim 7, wherein at least one of the connecting bogies comprises an electrical driving/braking unit having a different power from an electrical driving/braking unit of one of the other connecting bogies.

13. The rail vehicle system as claimed in claim 7, wherein the connecting bogies comprise:

load sensors for detecting a current loading of individual axles of the connecting bogies; and decentralized controllers for receiving the current loading detected by the load sensors and for driving or braking the individual axles separately according to the current loading.

14. The rail vehicle system as claimed in claim 13, further comprising a central vehicle control computer in a control unit for communication with the decentralized controllers via a bus system.

15. A connecting bogie comprising:

two halves which are separable and which may be coupled together mechanically or magnetically;

at least two axles, of which at least one is provided with an electrical driving/braking unit;

wherein one or more control units, supply units, or transport units forming a rail vehicle system can be connected to one another by the connecting bogies, each control unit, supply unit, or transport unit being connected to one of the connecting bogies halves.

16. The connecting bogie as claimed in claim 15, further comprising:

one or more load sensors for detecting a current loading of individual axles of the connecting bogie; and one or more decentralized controllers for receiving the current loading detected by the load sensors and for driving or braking the individual axles separately according to the current loading.

* * * * *